US007198457B2

(12) United States Patent
Chiba et al.

(10) Patent No.: US 7,198,457 B2
(45) Date of Patent: Apr. 3, 2007

(54) SINGLE-SHAFT MULTISTAGE PUMP

(75) Inventors: Yoshimasa Chiba, Tsukuba (JP); Choichi Ishikawa, Tsuchiura (JP); Hiroyuki Katsura, Tsuchiura (JP); Daimon Abe, Ishioka (JP)

(73) Assignee: Hitachi Industries Co., Ltd., Tokyo (JP)

( * ) Notice: Subject to any disclaimer, the term of this patent is extended or adjusted under 35 U.S.C. 154(b) by 341 days.

(21) Appl. No.: 10/912,554

(22) Filed: Aug. 6, 2004

(65) Prior Publication Data

US 2005/0158165 A1 Jul. 21, 2005

(30) Foreign Application Priority Data

Jan. 15, 2004 (JP) ..... 2004-007907

(51) Int. Cl.
*F04D 1/06* (2006.01)
*F04D 29/04* (2006.01)

(52) U.S. Cl. ..... 415/104; 415/198.1; 415/229

(58) Field of Classification Search ..... 415/104, 415/198.1, 199.1, 199.2, 229; 384/297, 909
See application file for complete search history.

(56) References Cited

U.S. PATENT DOCUMENTS 3,025,070 A * 3/1962 Copes ..... 277/370
6,981,799 B2 * 1/2006 Sturm et al. ..... 384/297
2005/0281498 A1 * 12/2005 Hayashi et al. ..... 384/297

FOREIGN PATENT DOCUMENTS

| | | |
|---|---|---|
| DE | 10038586 | 2/2002 |
| EP | 0667456 | 8/1995 |
| JP | A-11-270489 | 10/1999 |
| JP | A-2001-248586 | 9/2001 |
| JP | 2002-139045 | * 5/2002 |
| JP | A-2002-242881 | 8/2002 |

OTHER PUBLICATIONS

K. Gaffal et al., "Innovatives, Umweltfreundliches und Wirtschaftliches Speisepumpenkonzept Erfolgreich Erprobt", VGB Kraftwerkstechnik, Mar. 1, 1993, pp. 223-230, vol. 73, No. 3, VGB Kraftwerkstechnik GmbH, Essen, DE, XP000355089, ISSN: 0372-5715.
European Search Report dated Jan. 26, 2006.

* cited by examiner

*Primary Examiner*—Edward K. Look
*Assistant Examiner*—Nathan Wiehe
(74) *Attorney, Agent, or Firm*—Crowell & Moring LLP

(57) ABSTRACT

A single-shaft multistage pump is provided to make small-sized and space-saved possible. The single-shaft multistage pump includes a rotary shaft on which impellers are disposed at multiple stages, bearings and for supporting the rotary shaft, and a balance device adapted to apply, to the rotary shaft, a balance thrust force opposing an impeller thrust force. A water-lubricated bearing is used as each of the radial bearings, and the rotary shaft is supported by the water-lubricated bearings with a balance member of the balance device interposed therebetween.

6 Claims, 6 Drawing Sheets

SINGLE-SHAFT MULTISTAGE PUMP

BACKGROUND OF THE INVENTION

The present invention relates to a pump used suitably for supplying of water to a boiler, and particularly, to a single-shaft multistage pump having a structure in which impellers for pressurizing drawn water are mounted at multiple stages on a single rotary shaft.

A conventional typical structure of a single-shaft multistage pump used, for example, for supplying water to a boiler is designed as shown in FIG. 6 (for example, see JP-A-2002-242881 and JP-A-2001-248586). As can be seen in FIG. 6, the single-shaft multistage pump includes a rotary shaft 1, impellers 2, a radial bearing 3 for a suction port-side end, a radial bearing 4 for a discharge port-side end, a thrust bearing 5 for the discharge port-side end, a seal device 6 for the suction port-side end, a seal device 7 for the discharge port-side end, and a balance device 8. The single-shaft multistage pump also includes a housing 10 in which the rotary shaft 1, the impellers 2 and the like are accommodated. The housing 10 comprises a suction casing 12 provided with a suction port 11, a stage 13 in which the impellers 2 are accommodated, a discharge casing 15 provided with a discharge port 14, and a stuffing box or a seal box 16.

The rotary shaft 1 is connected through a spacer S and a coupling C directly to an output shaft of a drive unit D, so that it is rotated under reception of a rotational driving force from the drive unit D in a state in which it is supported at its suction port-side end and its discharge port-side end in a radial direction by a radial bearing 3 and a radial bearing 4 each of which is a sliding bearing, respectively, and also supported at its discharge port-side end in a thrust direction by a thrust bearing 5. The radial bearings 3 and 4 and the thrust bearing 5 are generally oil-lubricated bearings, respectively. In the case of the oil-lubricated bearing, the bearing is supplied with a lubricating oil from a hydraulic system (not shown). The impellers 2 are disposed at a plurality of stages on the rotary shaft 1, so that they are rotated with the rotation of the rotary shaft 1 to pressurize supplied water W drawn from the suction port 11 sequentially at the individual states to a predetermined pressure. Then, high-pressure water Wh pressurized to the predetermined pressure is discharged from a discharge port.

In a course of pressurizing the water by the impellers 2, a thrust force (an impeller thrust force) in a sideways direction of a suction port is generated axially on the rotary shaft 1. The balance device 8 is mounted in order to overcome the impeller thrust force. The balance device 8 is comprised of a balance member 21 which is formed into a disk shape (a shape in an example in FIG. 7) or a drum shape, as shown in an enlarged scale in FIG. 7, and which is fixedly mounted to the rotary shaft 1, an intermediate chamber 22 defined in a surface of the balance member 21 on the side of the suction port, and a balance chamber 23 defined in the surface of the balance member 21 on the side of the discharge port. The intermediate chamber 22 is in communication with the discharge port 14 through a very small clearance (not shown) formed along an outer periphery of a boss portion 21*b* of the balance member 21, so that a high pressure is generated in the intermediate chamber by the high-pressure water Wh. On the other hand, the balance chamber 23 is in communication with the suction port 11 through a balance pipe 24 and also with the intermediate chamber 22 through a very small clearance (no shown) intended to be changed in clearance width in association with the magnitude of the impeller thrust force, so that a pressure in the balance chamber 23 (this pressure is changed in accordance with the change in above-described clearance width) is lower than the pressure in the intermediate chamber 22. This brings about a state in which the disk portion 12*b* of the balance member 21 is urged in a direction toward a discharge port-side portion of the rotary shaft 23, whereby a thrust force (a balance thrust force) opposing the impeller thrust force is applied to the rotary shaft 1. As a result, it is possible to ensure that the thrust force generated on the rotary shaft 1 is smaller, or no substantial thrust force can be generated on the rotary shaft 1. In a case where no substantial thrust force can be generated on the rotary shaft 1 by virtue of such balance device 8, the thrust bearing 5 is not necessarily required, and may be omitted in some cases.

Each of the seal devices 6 and 7 is configured by a mechanical seal. More specifically, the seal device is of a structure in which the sealing is achieved by the sliding contact of the rotary ring 25 fixedly mounted to the rotary shaft 1 with the stationary ring 26 retained in a fixed state in the stuffing box or the seal box 16. The seal devices 6 and 7 serve to prevent water from being leaked to the outside along the rotary shaft 1, while also serving at the same time to prevent water from entering to the oil-lubricated radial bearings.

There are the following problems for the single-shaft multistage pump as described above: One of the themes is a reduction in size and a space-saving. A single-shaft multistage pump is increased in its axial size, because impellers are mounted at multiple stages on a single rotary shaft. For this reason, it is desired that the axial size reduced as much as possible to provide a space-saving in a pump system. With regard to this, for example, in each of the single-shaft multistage pumps disclosed in JP-A-2002-242881 and JP-A-2001-248586, a water-lubricated bearing is intended to be used for the bearing. As a result of the use of water-lubricated bearing, the seal device (the seal device 7 in FIG. 6) mounted for sealing the bearing against water is not required, and thus, a reduction in axial size can be realized, thereby providing a space-saving and further, a hydraulic system for supplying a lubricating oil is not required, whereby the arrangement around the pump can be simplified, which also provides a space-saving. In addition, in each of the single-shaft multistage pumps disclosed in JP-A-2002-242881 and JP-A-2001-248586, by employing the structure comprising the balance device and the thrust bearing integral with each other, one of the balance device and the thrust bearing is not required, whereby a reduction in axial size can be realized to provide a space-saving.

The use of the water-lubricated bearing for the bearing as in the techniques disclosed in JP-A-2002-242881 and JP-A-2001-248586 is effective for the reduction in size and the space-saving of the single-shaft multistage pump. In these prior arts, however, the water-lubrication of the bearing causing the seal device for the bearing to be not required is employed usefully only for the reduction in size of the single-shaft multistage pump, but there is still an unsatisfactory respect.

As described in JP-A-2002-242881, a water-lubricated carbon bearing is conventionally employed as the water-lubricated bearing. The carbon bearing is formed by sintering a carbon material and suffers from a problem that it is poor in shock resistance, because it is hard and brittle. This problem is particularly severe in the single-shaft multistage pump. More specifically, in the single-shaft multistage pump, the impellers are mounted at the multiple stages on the single rotary shaft and for this reason, the rotary shaft is longer and hence, a span between the bearings is longer. Therefore, the rotary shaft is liable to be brought into one-side collision against the bearings due to an increase in amount of rotary shaft flexed by its own weight and due to the whirling of the rotary shaft caused by a change in motional state. If the one-side collision occurs in a state in which a lubricating water film is not formed sufficiently on a slide surface of the bearing as at the start of the pump, the carbon bearing poor in shock resistance may be damaged in some cases. In addition, because the viscosity of water as a lubricant for the water lubrication is lower than that of an oil for the oil lubrication, the possibility of the damage to the bearing is increased, and the carbon bearing is defective in reliability and difficult to handle. Further, the carbon bearing is also accompanied by a problem concerning a sliding clearance (a clearance between an inner surface of the bearing and an outer surface of the rotary shaft). More specifically, the accuracy of the sliding clearance is important to form a sufficient water film, because of the low viscosity of water as the lubricant. However, the carbon material has a expansion coefficient larger than that of the rotary shaft and for this reason, the sliding clearance may be excessively widened in some cases due to a rise in temperature of the bearing after the start of the pump, whereby a sufficient water film may be not formed. In such a case, a solid lubrication occurs due to the absence of the water film, thereby causing the wearing of the bearing to be hastened.

The other problem resides in a maintenance regarding the seal device. It is usual to use the mechanical seal for the seal device, as described above. However, the mechanical seal is a component wasted earliest among various components, and hence, the frequency of the maintenance service and inspection is correspondingly increased. In the maintenance service and inspection of the seal device, it is necessary to remove the rotary ring and the stationary ring of the seal device in order to examine the worn state of the sliding surface. To carry out the operation for removing the rotary ring and the stationary ring in the conventional cylindrical seal device comprising the rotary ring and the stationary ring integral with each other, a operating procedure is required, for example, for the seal device for the suction port-side end, which comprises first removing a spacer and a coupling used to connect a drive unit and the rotary shaft to each other, thereby providing a state in which the end of the rotary shaft is open, and then withdrawing the rotary ring and the stationary ring along the rotary shaft. To inspect the seal device, it is necessary to disassemble even the bearings which are not required to be inspected. For this reason, a lot of time is required for the maintenance service and inspection, and thus, an improvement in maintenance property has been demanded.

BRIEF SUMMARY OF THE INVENTION

The invention is made based on the background of the above-described conventional single shaft multistage pump.

Accordingly, it is a first object of the present invention to provide a single-shaft multistage pump, wherein a further reduction in sizes and a space-saving can be achieved.

It is a second object of the present invention to provide a single-shaft multistage pump in which the water-lubricated bearing has a high reliability.

It is a third object of the present invention to provide a single-shaft multistage pump which is excellent in maintenance property.

To achieve the first object, according to the present invention, there is provided a single-shaft multistage pump comprising a rotary shaft on which impellers for pressurizing drawn water are disposed at multiple stages, radial bearings for supporting the rotary shaft in a radial direction, and a balance device adapted to apply a balance thrust force to the rotary shaft, the balance thrust force opposing an axial thrust force generated due to the pressurizing action of the impellers, wherein said radial bearings comprise a water-lubricated bearing, and the rotary shaft is supported by the water-lubricated radial bearings through a balance member of the balance device.

To achieve the second object, according to the present invention, there is provided a single-shaft multistage pump comprising a rotary shaft on which impellers for pressurizing drawn water are disposed at multiple stages, and bearings for supporting the rotary shaft, wherein a water-lubricated resinous bearing which has a slide element formed of a resin material and which can be lubricated using water is used as each of the bearings.

To achieve the third object, according to the present invention, there is provided a single-shaft multistage pump comprising a rotary shaft on which impellers for pressurizing drawn water are disposed at multiple stages, and a seal device comprising a rotary ring and a stationary ring for preventing the water from being leaked along the rotary shaft, wherein each of the rotary ring and the stationary ring is formed into a divided structure comprising a combination of a plurality of separate cylindrical members.

According to the present invention, the water-lubricated bearing is used as the radial bearing, and the rotary shaft is supported by the water-lubricated bearing through the balance member of the balance device. Therefore, it is possible to provide a reduction in axial size by virtue of no need for a seal device for the bearing brought about by the water-lubricated bearing and in addition, to provide a reduction in axial size by forming one of the radial bearings and the balance device integrally with each other, thereby realizing a further reduction in size and a space-saving.

According to the present invention, the water-lubricated resinous bearing is used as the bearing. The resinous bearing has many of characteristics suitable for the water-lubricated bearing for the single-shaft multistage pump, and the reliability for the bearing in the water lubrication can be enhanced remarkably.

Further, according to the present invention, each of the rotary ring and the stationary ring of the seal device is formed into a divided structure comprising the combination of the plurality of separate cylindrical members. Therefore, an operation for the maintenance service and inspection of the seal device can be carried out without removal of a spacer and a coupling used to connect a drive unit and the rotary shaft to each other, leading to a remarkable enhancement in maintenance property of the seal device.

The above and other objects, features and advantages of the invention will become apparent from the following description of the preferred embodiments taken in conjunction with the accompanying drawings.

DETAILED DESCRIPTION OF THE INVENTION

The present invention will now be described by way of preferred embodiments.

Figure 1:
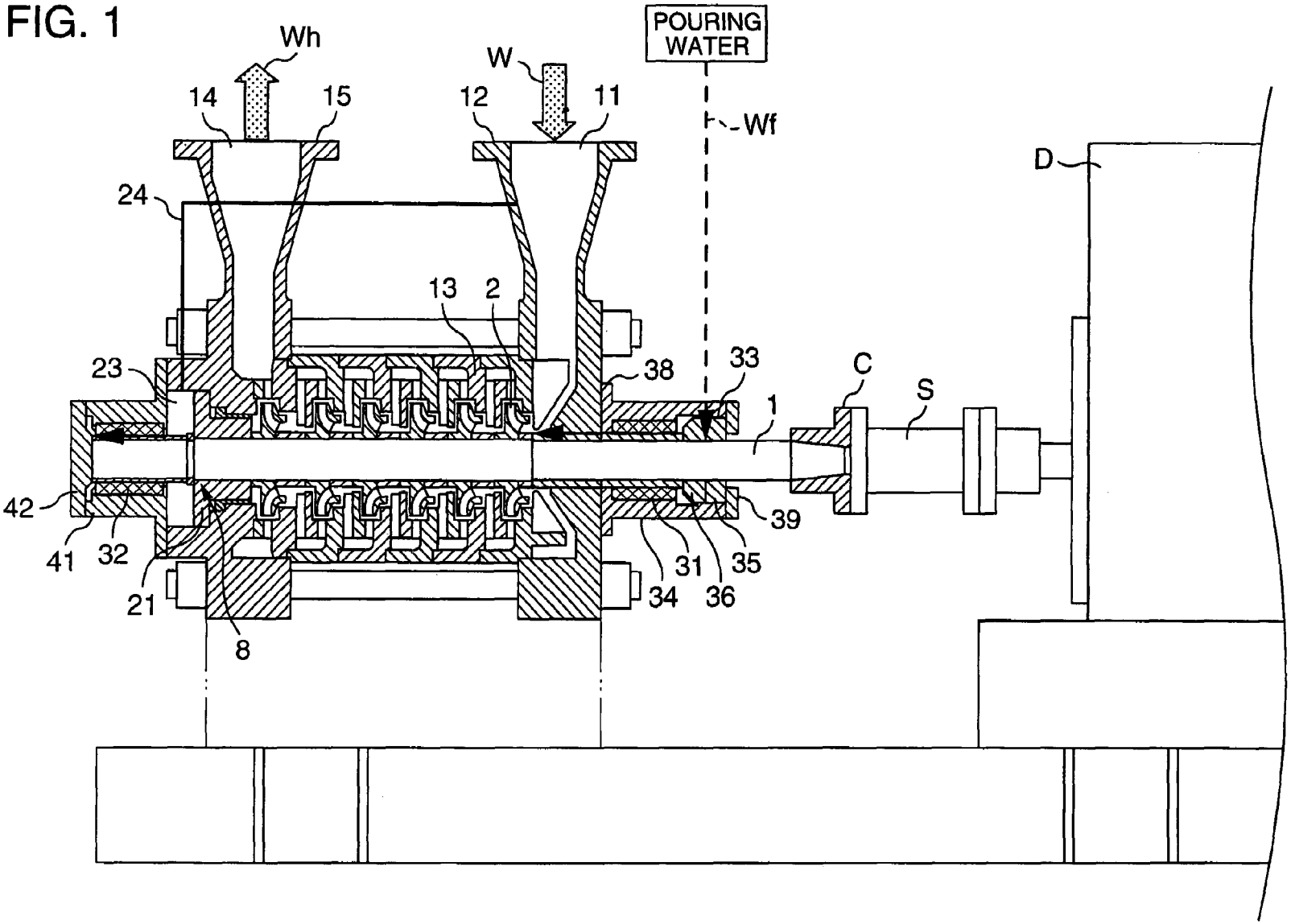
FIG. 1 is a view of a structure of a single-shaft multistage pump according to a first embodiment of the invention.
Figure 6:
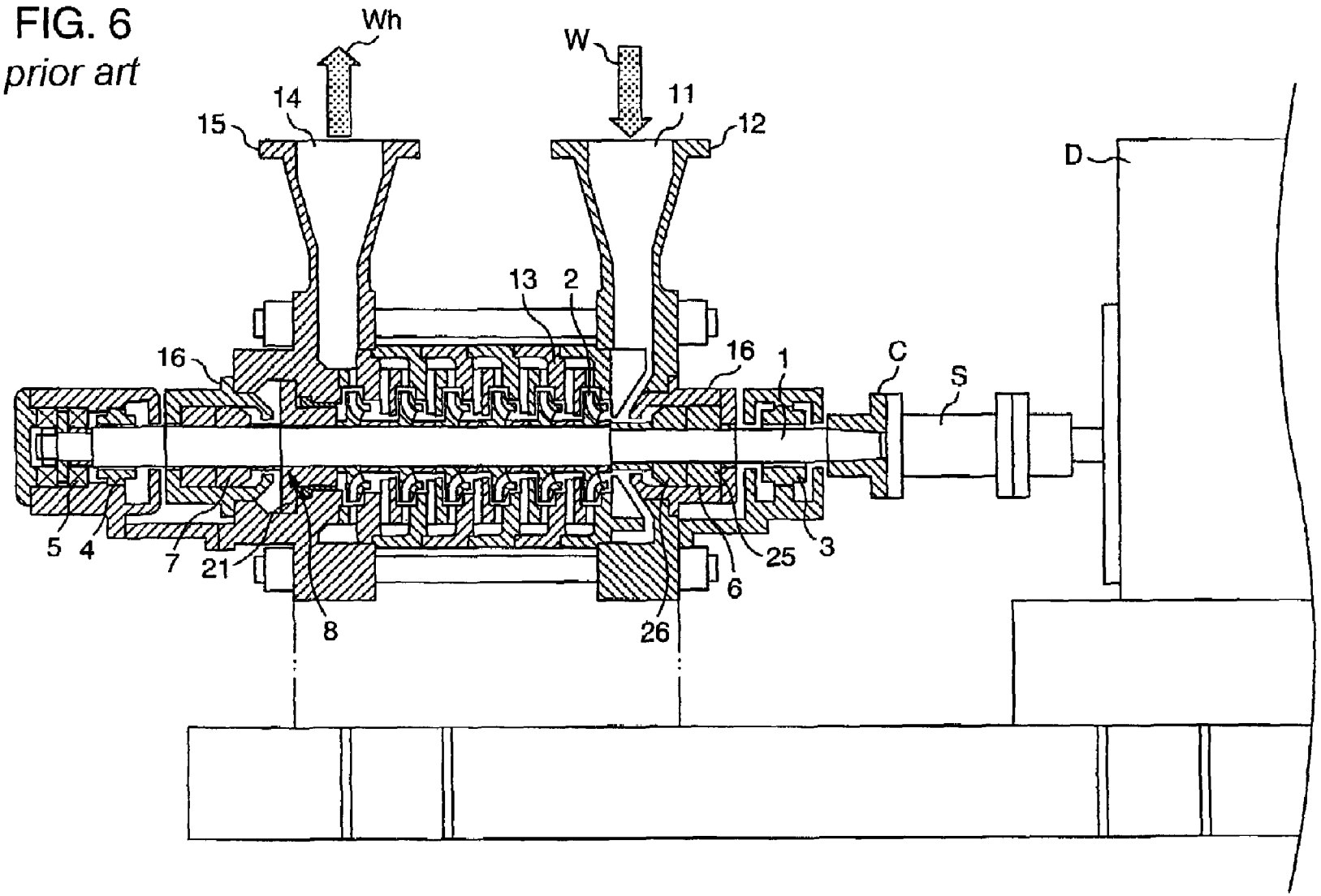
FIG. 6 prior art
FIG. 6 is a view showing the typical arrangement of a conventional single-shaft multistage pump.
Figure 7:
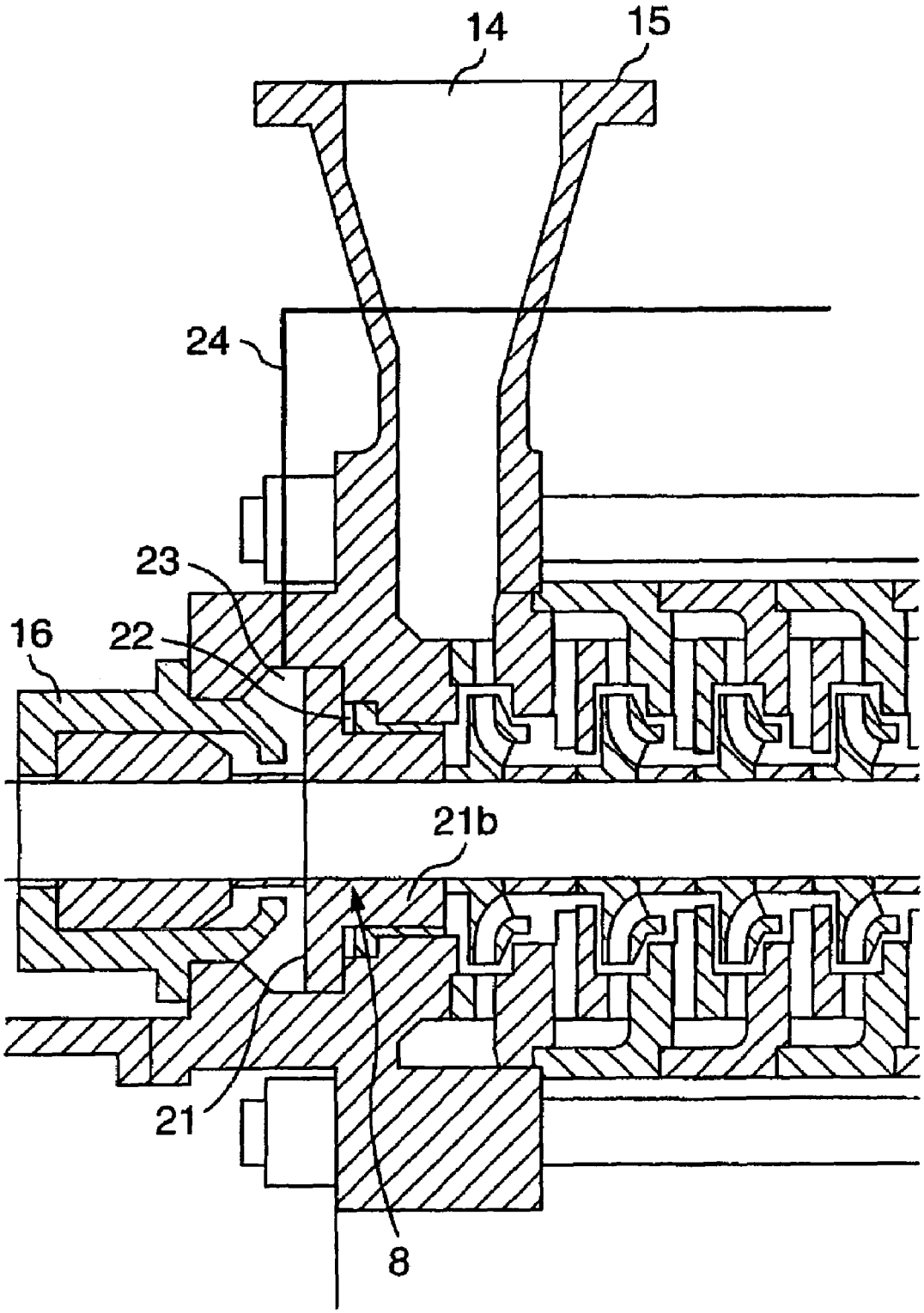
FIG. 7 prior art
FIG. 7 is an enlarged view of portions around a balance device in the single-shaft multistage pump in FIG. 6.

Referring to FIG. 1, the configuration of a single-shaft multistage pump according to a first embodiment is shown. The single-shaft multistage pump according to the first embodiment includes portions common to the conventional single-shaft multistage pump described above with reference to FIG. 6. These common portions are designated by the same reference characters and the description of them is omitted properly by the quotation of the above-description.

The featured arrangement of the single-shaft multistage pump according to the first embodiment is such that water-lubricated bearings are used for a radial bearing 31 for a suction port-side end and a radial bearing 32 for a discharge port-side end, that a seal device 33 for the suction port-side end is accommodated within an auxiliary casing 34 for the suction port-side end along with the radial bearing 31 in association with the fact that the radial bearing 31 for the suction port-side end is the water-lubricated bearing, and that a rotary ring 35 and a rotary ring 36 in the seal device 33 are of separated structures, respectively.

Resinous bearings formed of a resin material (a synthetic resin) are used as the water-lubricated bearings for the radial bearing 31 and the radial bearing 32. The resinous bearing is excellent in a shock resistance and a sliding characteristic. Therefore, even in the single-shaft multistage pump in which a rotary shaft is longer and liable to be largely flexed and whirled, damage cannot be caused in the bearing by the one-side collision due to the large flexing and the whirling. The resinous bearing can easily follow even the flexing of the longer rotary shaft in the single-shaft multistage pump, because of its excellent deformation followability, and the causing of the one-side collision of the rotary shaft to the bearing can be reduced. The resinous bearing is brought into a state in which a sliding clearance is narrowed due to a rise in temperature of the bearing after the start of the pump, because of its expansion coefficient smaller than that of the rotary shaft. Therefore, even when the bearing is lubricated by water having a lower viscosity, a sufficient water film is easily formed, and there is not a possibility that a solid-lubricated state due to the absence of water film is brought about, and thus, the life of the bearing can be prolonged. Further, the resinous bearing has a high heat resistance and can withstand a high temperature equal to or higher than 300° C. Even when water of a high temperature is pumped up, for example, as in the supplying of water to a boiler, it is unnecessary to supply cooling water to the bearing.

The preferred resin material, which may be used for the resinous bearing, includes various resins, such as, for example, PA (polyamide), POM (polyacetal), PBT (polybutylene terephthalate), PET (polyethylene terephthalate), PPE (polyphenylene ether), PC (polycarbonate), UHMW-PE (ultra high molecular weight polyethylene), PTFE (polytetrafluoroethylene), PPS (polyphenylene sulfide), PI (polyimide), PEEK (polyether ether ketone), PAR (polyacrylate), PSF (polysulfone), PEI (polyether imide), PAI (polyamide-imide), PES (polyether sulfone), and resins containing at least one of resins produced by polymerization of metathesis-polymerizable cycloolefins in the presence of a metathesis-polymerizing catalyst (these resins are herein provisionally referred to as metathesis-polymerized cycloolefins). More preferably, a material comprising any of these resins reinforced with carbon fiber is used. The carbon fiver-reinforced resin material which can be particularly preferably used includes carbon fiber-reinforced PEEK, carbon fiber-reinforced PPS, and carbon fiber-reinforced metathesis-polymerized cycloolefinic resin.

The use of the water-lubricated resinous bearings for the radial bearing 31 and the radial bearing 32 ensures that a seal device (the seal device 7 in FIG. 6) for preventing the entrance of water to the bearings as described above is not required because of the water lubrication, whereby the reduction in axial size can be achieved, thereby providing a space-saving, and that a hydraulic system for supplying a lubricating oil is not required, whereby the arrangement around the pump can be simplified, which also provides a space-saving. In addition, the resinous bearing has many of characteristics suitable for the water-lubricated bearing for the single-shaft multistage pump, whereby the reliability for the bearing in the water lubrication can be enhanced remarkably.

Figure 2:
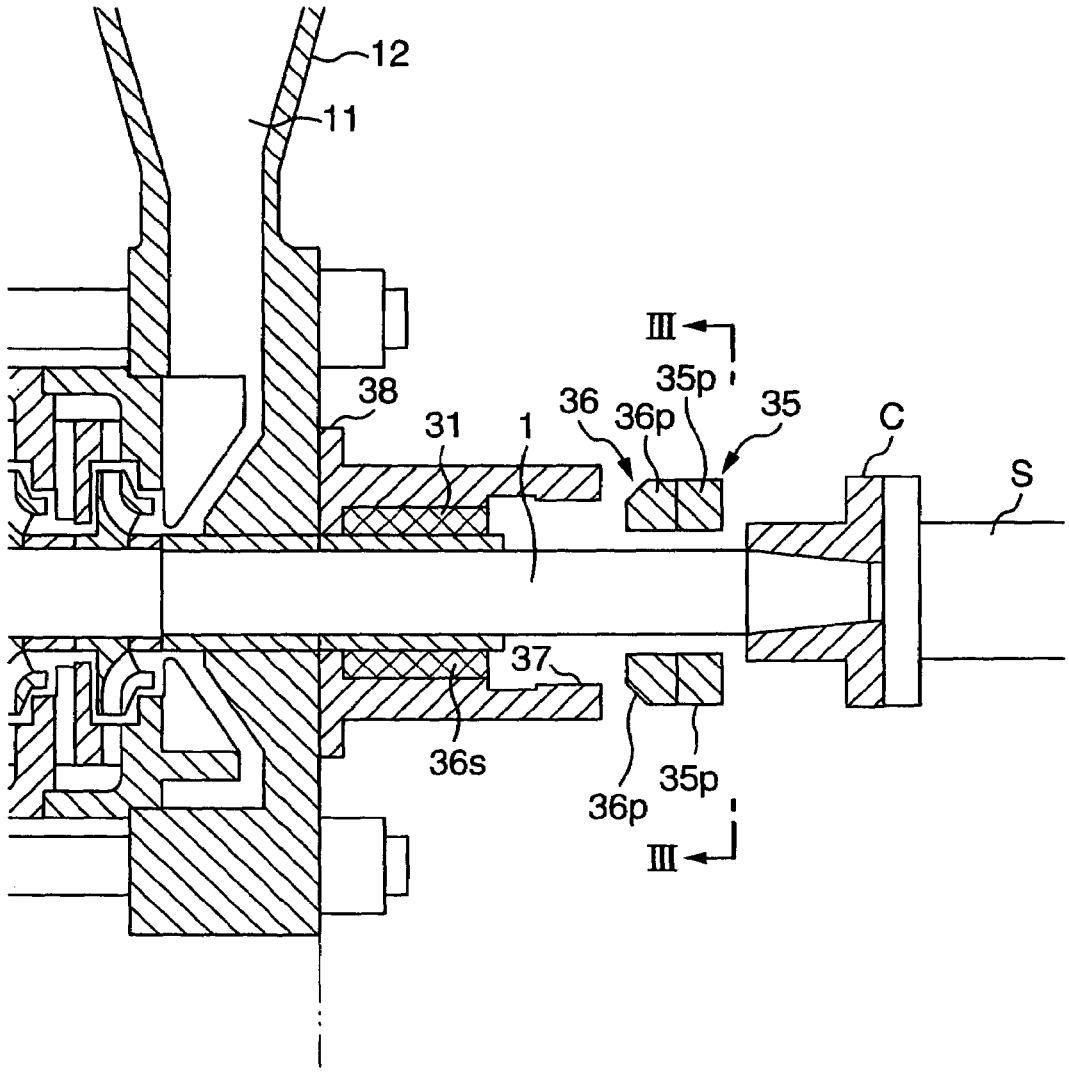
FIG. 2 is an enlarged view of portions around a seal device in the single-shaft multistage pump in FIG. 1 with a rotary ring and a stationary ring removed.

The auxiliary casing 34 is intended to accommodate the radial bearing 31 and the seal device 33 commonly, as described above, and is formed into a cylindrical shape with a support portion 37 for supporting the radial bearing 31 and a stationary ring retaining portion 36*s* functioning to retain the stationary ring 36 in the seal device 33 being formed in its inner peripheral surface, as shown in FIG. 2 in which portions around the auxiliary casing 34 are shown in a partially enlarged scale. The auxiliary casing 34 has a flange portion 38 formed at its front end, and its rear end is covered with a detachable rear cover 39 (not sown in FIG. 2) through which the rotary shaft 1 can be passed, so that when the rotary ring 35 and the stationary ring 36 in the seal device 33 are removed, as described hereinafter, the cover 39 can be opened. The auxiliary casing 34 is mounted to a suction casing 12 by a bolt (not shown) with the flange portion 38 interposed therebetween.

It is necessary to supply lubricating water to the radial bearing 31 accommodated in the auxiliary casing 34, and it is also necessary to supply water to the seal device 33 to clean a slide surface. For this purpose, the pouring of water Wf may be carried out. When the pouring of water Wf is required, water diverted from a suction port 11 or a discharge port 14 or water supplied from a water-pouring system provided specially is used. The water Wf poured is allowed to flow into the suction port 11, or discharged to the outside, after working to clean the slide surface of the seal device 33 and to lubricate the radial bearing 31. When high-pressure water from the discharge port 14 is used as water for lubricating the radial bearing 31, the radial bearing 31 can be a static pressure bearing. This also applies to the radial bearing 32.

The reason why the radial bearing 31 and the seal device 33 are accommodated commonly in the auxiliary casing 34 is that the need for preventing the entrance of water to the radial bearing 31 is eliminated, because the radial bearing comprises the water-lubricated bearing. As a result, it is possible to eliminate the need for a stuffing box or a seal box 16 in FIG. 6 mounted separately for the seal device in the prior art and thus, it is possible to correspondingly reduce the axial size of the single-shaft multistage pump.

Figure 3:
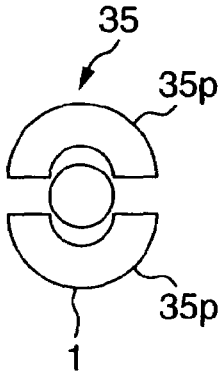
FIG. 3 is a view of the rotary ring taken in a direction of an arrow III—III in FIG. 2.

The rotary ring 35 in the seal device 33 is formed in a cylindrical shape having a split structure comprising a combination of two semi-cylindrical members 35*p*, 35*p* formed symmetrically, as shown in FIG. 3, and the stationary ring 36 is likewise formed in a cylindrical shape having a split structure comprising a combination of two semi-cylindrical members 36*p*, 36*p* formed symmetrically. By forming each of the rotary ring 35 and the stationary ring 36 of the seal device 33 into a divided structure (the split structure in the present embodiment) comprising a combination of a plurality of separate cylindrical members, as described above, the maintenance property of the seal device is enhanced remarkably. In the maintenance service and inspection of the seal device, it is necessary to demount the rotary ring 35 and the stationary ring 36 along the rotary shaft 1. The operation for demounting the rotary ring 35 and the stationary ring 36 can be carried out in the structure according to the present invention without removal of a spacer S and a coupling C used for connecting a drive unit D and the rotary shaft to each other. Namely, if the rear cover 39 for the auxiliary casing 34 is first removed to open the rear end of the casing 34, with the rotary shaft 1 remaining connected to the drive unit D through the spacer S and the coupling C, and the rotary ring 35 and the stationary ring 36 are then pulled out of the auxiliary casing 34, the rotary ring 35 can be removed easily from the rotary shaft 1 because of the split structure. By ensuring that the rotary ring 35 and the stationary ring 36 can be removed from the rotary shaft 1 with the rotary shaft 1 remaining connected to the drive unit, the maintenance property is enhanced remarkably, as compared with the prior art in which the operation for removing the spacer S and the coupling C is required.

In the present embodiment, even for the radial bearing 32, a auxiliary casing 41 for a discharge port-side end is mounted at the discharge port-side end of the rotary shaft 1 for accommodating the radial bearing 32, and the auxiliary casing 41 is covered with a rear cover 42, whereby the discharge port-side end of the rotary shaft 1 is closed in a sealed manner. By ensuring that the discharge port-side end of the rotary shaft 1 is brought into a sealed and closed state, as described above, the need for a seal device can be eliminated in association with the fact that the radial bearing 32 is the water-lubricated bearing, leading to a reduction in axial size as described above. However, it may be required in some cases for any reason that the discharge port-side end of the rotary shaft 1 is open. In such a case, a seal device is also mounted at the discharge port-side end, but it is preferable that such seal device is of the same structure as the seal device 33.

Figure 4:
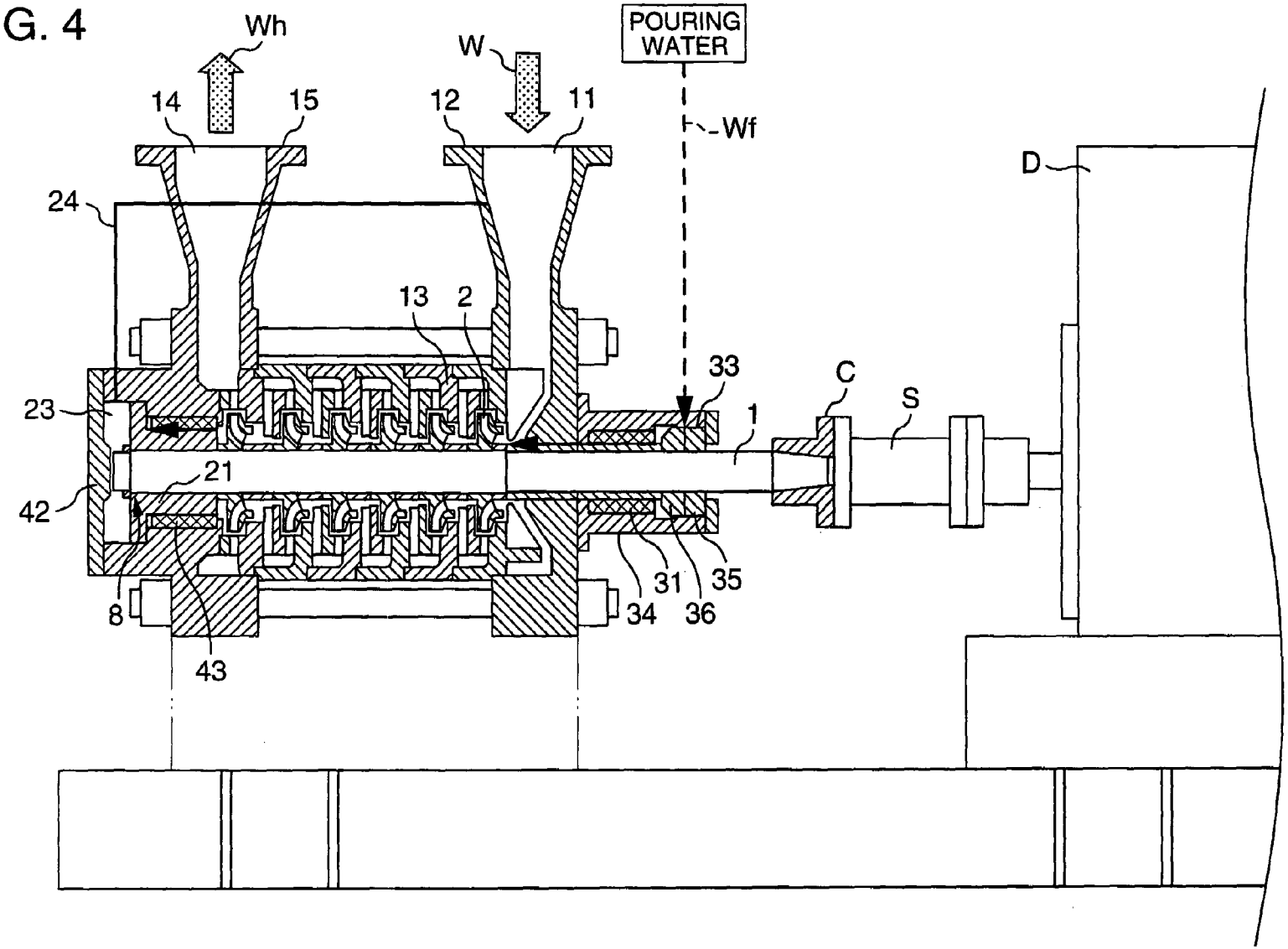
FIG. 4 is a view of the structure of a single-shaft multistage pump according to a second embodiment.

FIG. 4 shows the arrangement of a single-shaft multistage pump according to a second embodiment. The single-shaft multistage pump according to the second embodiment is basically similar to the single-shaft multistage pump according to the first embodiment. Therefore, portions common to those in the single-shaft multistage pump according to the first embodiment are designated by the same reference characters, and the description of them is omitted properly by the quotation of the above-description.

Figure 5:
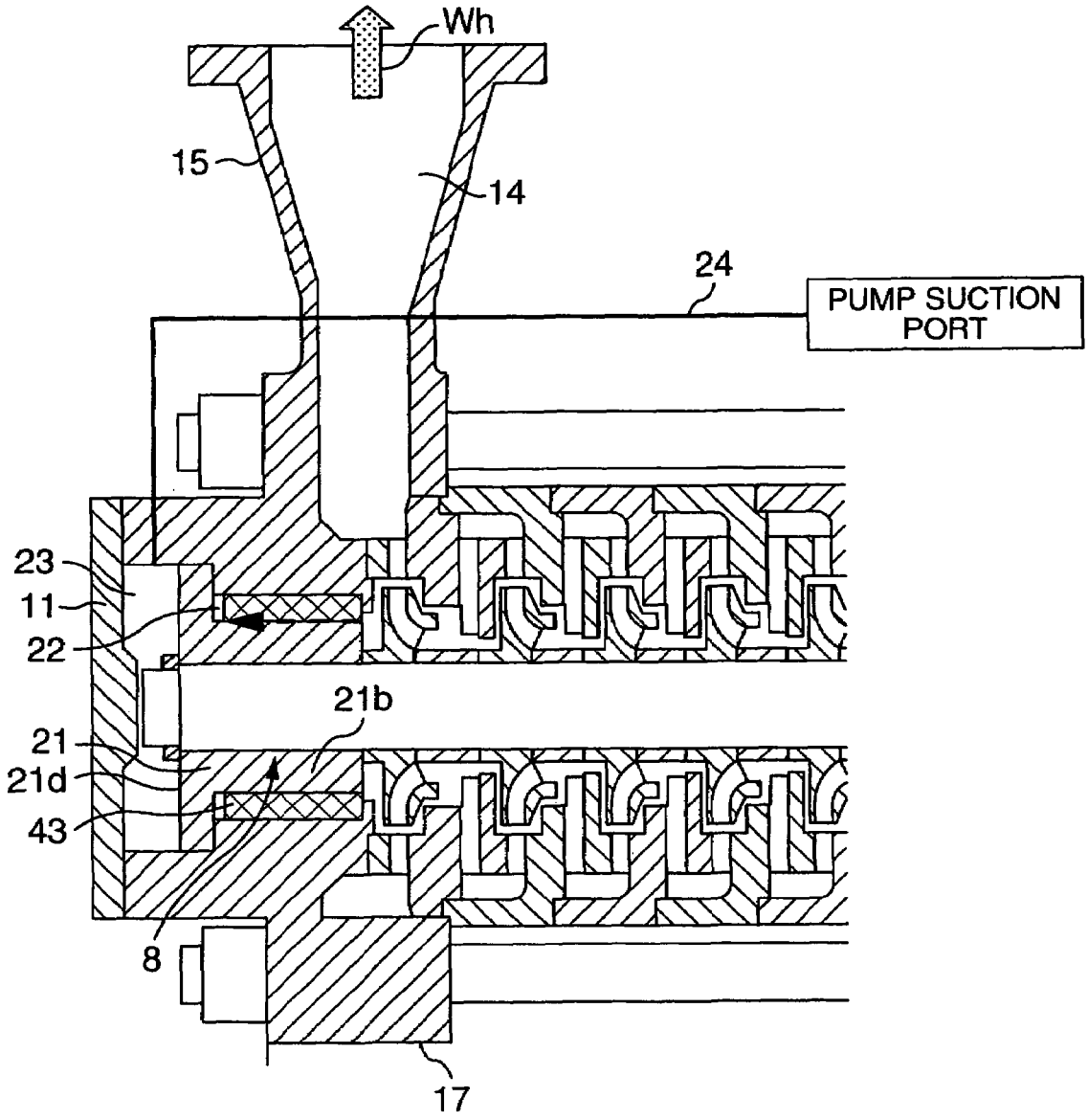
FIG. 5 is an enlarged view of portions around a balance device in the single-shaft multistage pump in FIG. 4.

The featured arrangement of the single-shaft multistage pump according to the present second embodiment is such that the supporting of a rotary shaft 1 by a water-lubricated radial bearing for a discharge port-side end is performed through a balance member 21 of a balance device 8. More specifically, as shown in a partially enlarged scale in FIG. 5, a boss portion 21*b* of the balance member 21 secured to the rotary shaft 1 is supported by the radial bearing 43, whereby the supporting of the rotary shaft 1 by the radial bearing 43 is achieved.

In this manner, the radial bearing 43 can be integrated with the balance device 8. As a result, for example, if compared with the single-shaft multistage pump according to the first embodiment, a space occupied by the radial bearing 32 or the balance device 8 can be eliminated, leading to a further reduction in axial size. It should be noted that even in the present embodiment, the need for a seal device at the discharge port-side end of the rotary shaft 1 is eliminated by closing the discharge port-side end in a sealed manner by covering the discharge port-side end of the rotary shaft 1 with a rear cover 42.

As discussed above, according to the present invention, a further reduction in axial size and a space-saving can be realized in the single-shaft multistage pump; the reliability for the bearings in the water lubrication can be enhanced remarkably and further, the maintenance property of the seal device can be enhanced remarkably. This can contribute largely to a further increase in function of the single-shaft multistage pump of the present invention.

Although the embodiments of the present invention have been described in detail, it will be understood that the present invention is not limited to the above-described embodiments, and various changes and modifications may be made without departing from the spirit of the invention and the scope of the appended claims.

The invention claimed is:

1. A single-shaft multistage pump comprising a rotary shaft on which impellers for pressurizing drawn water are disposed at multiple stages, radial bearings for supporting said rotary shaft in a radial direction thereof, and a balance device adapted to apply a balance thrust force to said rotary shaft, the balance thrust force opposing an axial thrust force generated due to the pressurizing action of said impellers, wherein said radial bearings comprise a water-lubricated bearing, and said rotary shaft is supported by said water-lubricated radial bearings through a balance member of said balance device.

2. A single-shaft multistage pump according to claim 1, wherein each of said water-lubricated bearings used is a water-lubricated resinous bearing including a slide element formed of a resin material.

3. A single-shaft multistage pump according to claim 2, wherein said resin material comprises a polyether ether ketone (PEEK).

4. A single-shaft multistage pump according to claim 1, further comprising, a seal device having a rotary ring and a stationary ring for preventing said water from leaking along said rotary shaft, each of said rotary ring and said stationary ring of said seal device comprises a divided structure dividable diametrically, whereby maintenance of said seal device can be accomplished without removal of said coupling.

5. A single-shaft multistage pump according to claim 4, wherein each of said rotary ring and said stationary ring having a divided structure is formed into a split structure comprising two semi-cylindrical members.

6. A single-shaft multistage pump comprising a rotary shaft on which impellers for pressurizing drawn water are disposed at multiple stages, radial bearings for supporting said rotary shaft, a seal device having a rotary ring and a stationary ring for preventing said water from being leaked along said rotary shaft, a drive unit for driving said rotary shaft, and a coupling for connecting one end of said rotary shaft to said drive unit, wherein a water-lubricated resinous bearing which has a slide element formed of a resin material and which can be lubricated using water is used as each of said radial bearings, and each of said rotary ring and said stationary ring of said seal device is formed into a divided structure which can be divided diametrically, whereby a maintenance of said seal device can be accomplished without removal of said coupling, further comprising a balance device adapted to apply a balance thrust force to said rotary shaft, the balance thrust force opposing an axial thrust force generated due to the pressurizing action of said impellers, and wherein said water-lubricated resinous bearings are disposed outside a balance member of said balance device, and said rotary shaft is supported by said water-lubricated resinous bearings with said balance member interposed therebetween.

* * * * *